US006226913B1

(12) United States Patent
Haimovich et al.

(10) Patent No.: US 6,226,913 B1
(45) Date of Patent: May 8, 2001

(54) WEAPON TAG

(75) Inventors: Yosef Haimovich, Rishon le Zion; Yehuda Armoni, Reut; Michael Auerbach, Maccabim, all of (IL)

(73) Assignee: Hi-G-Tek Ltd., Or-Yehuda (IL)

( * ) Notice: Subject to any disclaimer, the term of this patent is extended or adjusted under 35 U.S.C. 154(b) by 0 days.

(21) Appl. No.: 09/305,488

(22) Filed: May 5, 1999

(30) Foreign Application Priority Data

May 7, 1998 (IL) ..... 124362

(51) Int. Cl.[7] ..... F41A 17/06
(52) U.S. Cl. ..... 42/1.01; 42/70.01
(58) Field of Search ..... 42/1.01, 1.02, 42/1.03, 1.04, 1.05, 70.01, 70.02, 70.04, 70.08

(56) References Cited

U.S. PATENT DOCUMENTS

| | | | | |
|---|---|---|---|---|
| 3,453,892 | | 7/1969 | Hudson | 73/489 |
| 3,785,261 | | 1/1974 | Ganteaume | 95/12 |
| 3,914,996 | | 10/1975 | Davis et al. | 73/167 |
| 4,488,370 | * | 12/1984 | Lemelson | 42/70.01 |
| 4,541,191 | * | 9/1985 | Morris et al. | 42/1.01 |
| 4,748,668 | | 5/1988 | Shamir et al. | 380/30 |
| 5,033,217 | | 7/1991 | Brennan | 42/1.01 |
| 5,097,253 | | 3/1992 | Eschbach et al. | 340/545 |
| 5,189,395 | * | 2/1993 | Mitchell | 340/539 |
| 5,291,680 | | 3/1994 | Schabdach et al. | 42/105 |
| 5,406,730 | * | 4/1995 | Sayre | 42/1.02 |
| 5,416,486 | * | 5/1995 | Koert et al. | 342/42 |
| 5,437,117 | | 8/1995 | Mackey, III | 42/1.01 |
| 5,537,771 | * | 7/1996 | Martin | 42/70.01 |
| 5,566,486 | | 10/1996 | Brinkley | 42/1.02 |
| 5,656,996 | | 8/1997 | Houser | 340/541 |
| 5,700,088 | | 12/1997 | Piacente et al. | 374/141 |
| 5,715,623 | | 2/1998 | Mackey, III | 42/1.01 |

FOREIGN PATENT DOCUMENTS

| | | | | |
|---|---|---|---|---|
| 4022038 | * | 1/1992 | (DE) | 42/1.03 |
| 2182424 | * | 5/1987 | (GB) | 42/1.02 |

OTHER PUBLICATIONS

U.S. patent application No.: 08/815,389.
*Brochure*: "Electronic Armory", by Hi–G–Tek, Israel, no date.

* cited by examiner

*Primary Examiner*—Stephen M. Johnson
(74) *Attorney, Agent, or Firm*—Abelman, Frayne & Schwab

(57) ABSTRACT

A weapon including a housing, a firing mechanism, and an electronic tag providing at least a unique identification of the weapon. The electronic tag may be located within the housing in a location normally physically inaccessible to users of the weapon.

12 Claims, 2 Drawing Sheets

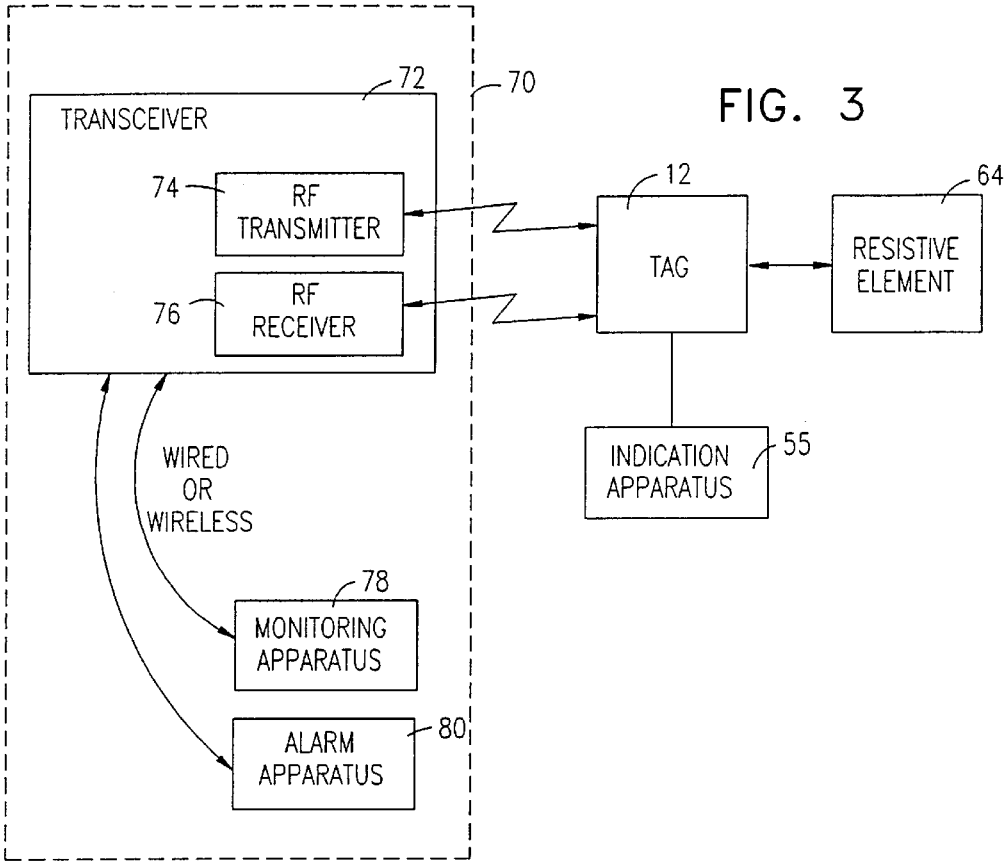
FIG. 3
FIG. 4
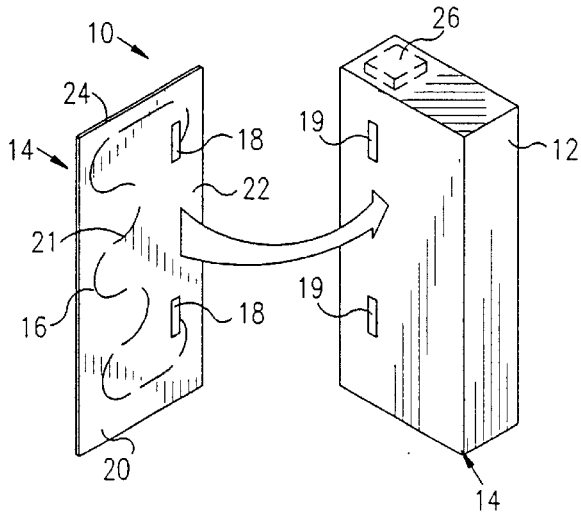

WEAPON TAG

FIELD OF THE INVENTION

The present invention relates generally to apparatus and methods for weapon identification and particularly to an electronic tag which provides a unique identification of the weapon.

BACKGROUND OF THE INVENTION

It is known to use electronic devices to monitor attempted tampering of weapons. For example, U.S. Pat. No. 5,437,117 to Mackey, III describes a firearm safety device shaped like a bullet which can be inserted in the chamber of a firearm. The safety device produces an audible alarm when the firearm is moved or handled, thereby, for example, alerting of an attempt to steal the weapon. U.S. Pat. No. 5,715,623, also to Mackey, III describes a transmitter unit adapted for connection to a firearm which produces a non-audible alarm signal when the firearm is moved or handled. A discrete receiver unit, positioned at a remote location receives the signal from the transmitter and produces an audible alarm.

A disadvantage of the prior art is that if an unscrupulous person were to remove the alarm device from the weapon or, in some cases, tamper with the alarm device on the weapon, no detection is made of such mischievous activities. In other words, the device can remain intact and functioning and yet not trigger an alarm that the device has been removed from the weapon or otherwise tampered with.

SUMMARY OF THE INVENTION

The present invention seeks to provide an improved electronic tag which provides a unique identification of the weapon. Unlike the prior art, if the tag of the present invention is removed from the weapon, or modified, the tag provides an indication of such tampering. The tag thus establishes a unique identification of the weapon.

The tag may comprise an embedded structure, such as a wire loop or other resistance element, which is extremely difficult to remove without detection. The security of the tag may be enhanced by adding encryption and authentication circuitry.

There is thus provided in accordance with a preferred embodiment of the present invention a weapon including a housing, a firing mechanism, and an electronic tag providing at least a unique identification of the weapon.

In accordance with a preferred embodiment of the present invention the electronic tag is located within the housing in a location normally physically inaccessible to users of the weapon.

Further in accordance with a preferred embodiment of the present invention the electronic tag also provides an output indication of at least one aspect of the operational history of the weapon.

Still further in accordance with a preferred embodiment of the present invention the electronic tag provides an output indication of a number of firings carried out by the firing mechanism.

Additionally in accordance with a preferred embodiment of the present invention the electronic tag provides an output indication of tampering therewith and attempted removal thereof In accordance with a preferred embodiment of the present invention the electronic tag is interrogatable from outside the weapon, without requiring removal of the electronic tag from the weapon.

Further in accordance with a preferred embodiment of the present invention the electronic tag provides an output indication to a location outside the weapon.

Still further in accordance with a preferred embodiment of the present invention the electronic tag wirelessly transmits the output indication.

Additionally in accordance with a preferred embodiment of the present invention the electronic tag communicates in an encrypted manner.

BRIEF DESCRIPTION OF THE DRAWINGS

The present invention will be understood and appreciated more fully from the following detailed description, taken in conjunction with the drawings in which:

FIG. 3 is a simplified block diagram of the electronic tag of FIG. 2, in accordance with a preferred embodiment of the present invention; and FIG. 4 is a simplified pictorial illustration of a monitored attachment mechanism useful with the electronic tag of FIG. 2.

DETAILED DESCRIPTION OF A PREFERRED EMBODIMENT

Figure 1:
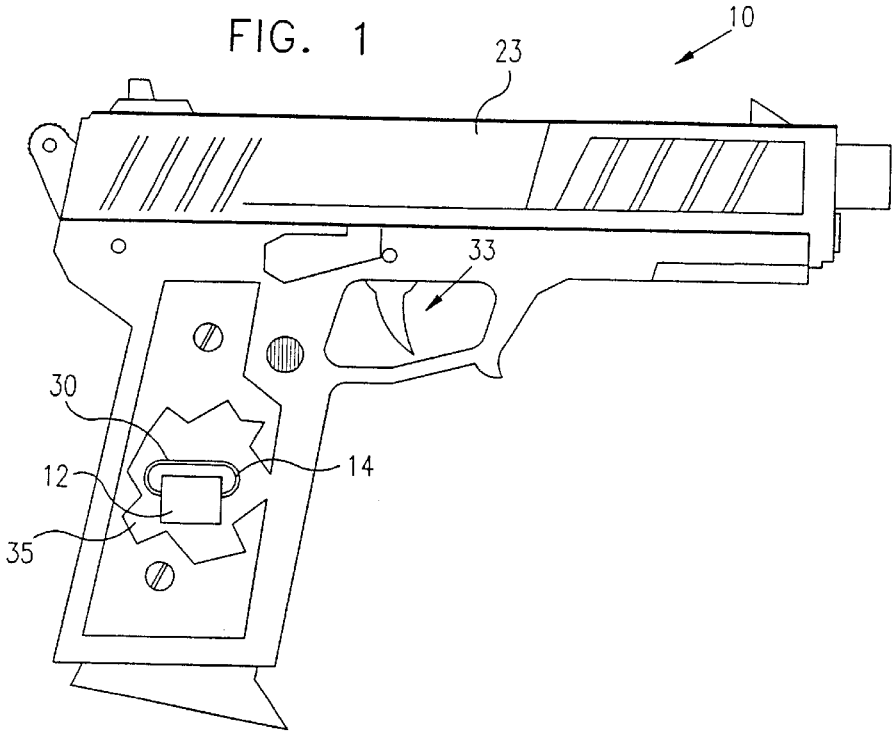
FIG. 1 is a simplified pictorial illustration of a weapon constructed and operative in accordance with a preferred embodiment of the present invention.

Reference is now made to FIG. 1 which illustrates a weapon 10 including a housing 23, a firing mechanism 33, an electronic tag 12 and a monitored attachment mechanism 14 which attaches tag 12 to weapon 10 and which provides an output indication of tampering with attachment mechanism 14, as will be described herein below. Of course, weapon 10 may be any kind of weapon and is not limited to the illustrated hand gun.

Electronic tag 12 is preferably constructed in accordance with the teachings of U.S. patent application Ser. No. 08/815,389, the disclosure of which is incorporated herein by reference, and as such, preferably houses electronics (not shown) comprising a battery, a receiver antenna, receiver circuitry, a transmitter antenna, transmitter circuitry, a microprocessor, a timer, a logic and memory component, an analog-to-digital (A/D) converter and a current source. The electronics of tag 12 is not limited to the abovementioned components, and may include more or less components, depending upon the application. In a most preferred embodiment, tag 12 does not comprise a battery, but rather is powered wirelessly by a remote device.

Monitored attachment mechanism 14 preferably includes a frangible element 30, which when broken provides an output indication of tampering with attachment mechanism 14. Preferably a recess 35 is formed in weapon 10 and electronic tag 12 and mechanism 14 are embedded in recess 35 and encased in epoxy or other protective material. Recess 35 is formed in any location normally physically inaccessible to users of weapon 10, preferably on some part of weapon 10 which is not detachable from weapon 10, such as a magazine well, for example. Recess 35 may be formed as part of the original manufacture of weapon 10 or may be reworked into a previously manufactured weapon 10.

Figure 2:
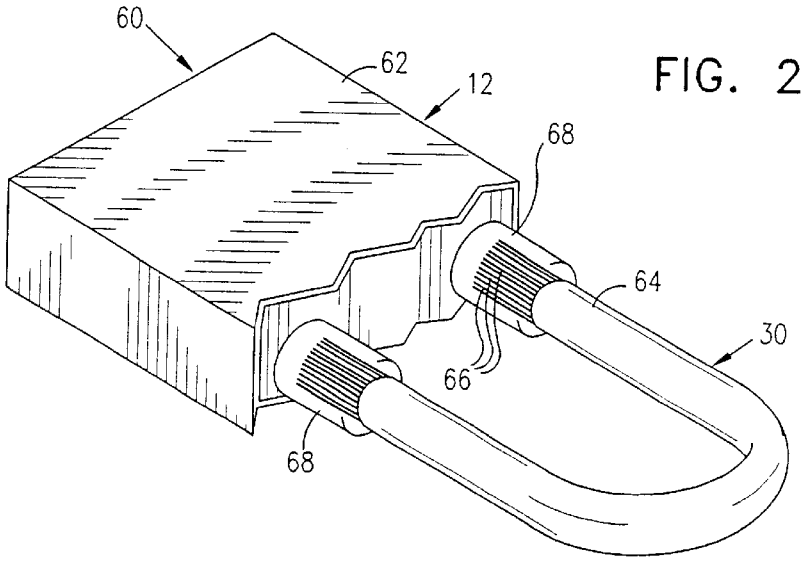
FIG. 2 is a simplified pictorial illustration of an electronic tag used in the weapon of FIG. 1, constructed and operative in accordance with a preferred embodiment of the present invention.

Reference is now made to FIG. 2 which more clearly illustrates electronic tag 12, constructed and operative in accordance with a preferred embodiment of the present invention. Frangible element 30 preferably includes a resistive element 64 which comprises one or more resistive wires 66, preferably constructed of a high resistivity material such as nickel chrome. Each wire 66 is insulated from each other and from the external world. Wires 66 are attached to internal I/O pins 68 of tag 62, such as by crimping or soldering, wherein only a random number of wires 66 are electrically connected to pins 68 and the remainder of wires 66 are not connected to pins 68. The random connection results in a statistically random electrical resistance of resistive element 64, which resistance cannot be measured from the outside of tag 62.

Removal of tag 12 from weapon 10 causes shearing or other deformation of wires 66, and alters the resistance of resistive element 64. Alteration of the resistance of element 64 may be stored in a memory component (not shown in FIG. 2) and/or may be transmitted, wired or wirelessly, to a detection system which will now be described with reference to FIG. 3.

Reference is now made to FIG. 3 which illustrates a simplified block diagram of electronic tag 12, in accordance with a preferred embodiment of the present invention. A detection system 70 is provided which preferably includes a transceiver 72 which communicates with tag 12 via a wireless transmitter 74 and a wireless receiver 76. (As mentioned above, wired communication may alternatively be employed.) Transceiver 72 preferably also communicates with monitoring apparatus 78 and/or alarm apparatus 80, via wired or wireless communication, such as a LAN.

Preferably tag 12 operates in a sleeping mode so as to conserve energy of its power source, not shown, In the case that tag 12 has its own power source. Tag 12 is activated only upon receipt of a wake-up signal from transceiver 72. Once tag 12 is activated, any change in electrical resistance of resistive element 64 is communicated or monitored. For example, the change in resistance may be stored in the memory component and/or relayed to transceiver 72 and thence to either monitoring apparatus 78 or alarm apparatus 80. A timer (not shown in FIG. 3) and/or the memory component may be used to monitor time and duration of the change in electrical resistance.

Preferably the memory component stores identification data and/or asset data. Transceiver 72 may interrogate tag 12 for the identification and/or asset data. The asset data may include a variety of information about weapon 10, including inventory and sub-inventory information.

In accordance with a preferred embodiment of the present invention, in order to enhance security, tag 12 communicates with detection system 70 in an encrypted manner. For example, well known encryption algorithms, such as RC-5, DES or DVB, may be employed. To provide an even greater level of trust, mutual zero-knowledge interaction authentication sessions between tag 12 and detection system 70 may be held, such as the so-called Fiat-Shamir authentication methods taught in U.S. Pat. No. 4,748,668 to Shamir and Fiat, the disclosure of which is incorporated herein by reference.

As one example, tag 12 may communicate with detection system 70 in a manner requiring authentication by tag 12. Additionally or alternatively, tag 12 may communicate with detection system 70 only upon authorization from detection system 70 itself Additionally in accordance with a preferred embodiment of the present invention, tag 12 provides an output indication of at least one aspect of the operational history of weapon 10 and/or an output indication of a number of firings carried out by firing mechanism 33. Apparatus is known for providing such indications, such as U.S. Pat. Nos. 3,785,261 to Ganteaume, 3,914,996 to Davis et al., 4,541,191 to Morris et al., and 5,566,486 to Brinkley, the disclosures of which are incorporated herein by reference. Such indication apparatus is generally indicated by reference numeral 55 in FIG. 3.

Reference is now made to FIG. 4 which illustrates an alternative construction of monitored attachment mechanism 14. In this embodiment, monitored attachment mechanism 14 preferably includes an electrically resistive element 16 which is in electrical communication with the electronics of tag 12, such as via mating I/O pads 18 and 19, respectively. In the illustrated embodiment, monitored attachment mechanism 14 comprises a sticker 20 on which resistive element 16 is disposed. Resistive element 16 may be disposed on sticker 20 in a variety of manners. For example, sticker 20 may include a flexible material, such as polyester or polyimide films, e.g., MYLAR or KAPTON. Resistive element 16 may comprise a resistive ink 21, preferably polymer based, which is applied onto sticker 20. Resistive ink 21 may be applied in a variety of manners, e.g., screen printing, roller coating, dipping, transfer deposition, or any other process that provides a controlled coating. Resistive ink 21 may be printed on sticker 20 in any suitable pattern to provide a desired resistance value which may be adjusted after curing by laser trimming, abrasion or mechanical punching, for example. I/O pads 18 are connected to the pattern of resistive ink 21, pads 18 being in electrical communication with I/O pads 19 of tag 12, as mentioned above. Sticker 20 is bonded to tag 12 with an adhesive 22. When assembled, resistive element 16 is on the outside surface of sticker 20, i.e., not between sticker 20 and tag 12.

As with resistive element 64, tag 12 and resistive element 16 are embedded in recess 35 and encased in epoxy or other protective material. Preferably the adhesive strength of adhesive 22 is greater than the adhesive strength of the encasing or potting material used to encase tag 12 in recess 35, but the adhesive strength of the encasing or potting material is stronger than the bond between resistive element 16 and sticker 20. This means that any attempt to peel, rip or otherwise unlawfully remove tag 12 from weapon 10, causes some deformation which alters the resistance of resistive element 16. Alteration of the resistance of element 16 may be stored in the memory component and/or may be transmitted via a communicator 26, such as a wireless transmitter, to detection system 70, thereby providing a sensible indication of receipt of the output indication of tampering with attachment mechanism 14.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A weapon comprising:

a housing including a firing mechanism; and an electronic tag mounted in said housing providing at least a unique identification of the weapon, wherein said tag comprises a monitored attachment mechanism which comprises a frangible element, wherein breaking said frangible element provides an output indication of tampering with said attachment mechanism, which is transmitted to a detection system.

2. The weapon according to claim 1 wherein said tag is embedded in a recess formed in said weapon, and encased in said recess with a protective material.

3. The weapon according to claim 1 wherein said frangible element comprises a resistive element wherein removal of said tag from said weapon causes a deformation of said resistive element and thereby alters an electrical resistance of said resistive element.

4. The weapon according to claim 3 herein said resistive element comprises a statistically random electrical resistance.

5. The weapon according to claim 3 wherein an alteration of the electrical resistance of said resistive element is transmitted to said detection system.

6. A weapon according to claim 1 wherein said electronic tag also provides an output indication of at least one aspect of the operational history of the weapon.

7. A weapon according to claim 1 wherein said electronic tag provides an output indication of a number of firings carried out by said firing mechanism.

8. A weapon according to claim 1 wherein said electronic tag provides an output indication of tampering therewith and attempted removal thereof.

9. A weapon according to claim 1 wherein said electronic tag is interrogatable from outside the weapon, without requiring removal of the electronic tag from the weapon.

10. A weapon according to claim 1 wherein said electronic tag provides an output indication to a location outside the weapon.

11. A weapon according to claim 10 and wherein said electronic tag wirelessly transmits said output indication.

12. A weapon according to claim 1 wherein said electronic tag communicates in an encrypted manner.

* * * * *